US012389987B2

(12) United States Patent
Gupta

(10) Patent No.: US 12,389,987 B2
(45) Date of Patent: Aug. 19, 2025

(54) MAGIC PIN WITH ULTRA GRIP

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 0 days.

(21) Appl. No.: 18/264,292

(22) PCT Filed: Jan. 6, 2022

(86) PCT No.: PCT/US2022/011470
§ 371 (c)(1),
(2) Date: Aug. 4, 2023

(87) PCT Pub. No.: WO2022/169546
PCT Pub. Date: Aug. 11, 2022

(65) Prior Publication Data

US 2024/0099431 A1 Mar. 28, 2024

Related U.S. Application Data

(60) Provisional application No. 63/145,696, filed on Feb. 4, 2021.

(51) Int. Cl.
*A44B 9/04* (2006.01)
*A41H 31/00* (2006.01)

(52) U.S. Cl.
CPC ..... *A44B 9/04* (2013.01); *A41H 31/00* (2013.01)

(58) Field of Classification Search
CPC .... A44B 9/04; A44B 9/02; A44B 9/06; A61H 39/086
USPC ..... 24/711.4
See application file for complete search history.

(56) References Cited

U.S. PATENT DOCUMENTS 1,268,752 A * 6/1918 Metcalf ..... D04B 17/04 D15/78
1,867,624 A * 7/1932 Hoffman ..... A61B 10/0266 600/7
2,308,000 A * 1/1943 Ellerstein ..... A44B 9/06 24/711.4
2,642,872 A * 6/1953 Parker ..... A44C 7/001 63/12

(Continued)

OTHER PUBLICATIONS

International Search Report and Written Opinion; PCT/US2022/011470; Mailed Mar. 29, 2022.

(Continued)

*Primary Examiner* — Jack W Lavinder
(74) *Attorney, Agent, or Firm* — Dunlap Bennett & Ludwig, PLLC; Anna L. Kinney

(57) ABSTRACT

A pin includes: (a) a pin shaft with a pin point; (b) an elongate pin head attached to an end of the pin shaft distal to the pin point having a pin head length, wherein the elongate pin head is characterized by an elongate tapered ribbed construction with a plurality of ribs defining a rib profile extending from an outer end of the elongate pin head distal to the pin shaft to an inner end of the elongate pin head proximate the pin shaft, said rib profile having a characteristic outer end dimension which is larger than a characteristic inner end dimension of the rib profile proximate the pin shaft, said elongate pin head being further characterized by a plurality of outwardly projecting gripping rings located a distance from the outer end of the pin head toward the inner end of the pin head.

10 Claims, 4 Drawing Sheets

(56) References Cited

U.S. PATENT DOCUMENTS 3,438,224 A * 4/1969 Ingersoll ..... D04B 3/00 66/117
3,565,302 A 2/1971 Dyer
3,861,392 A * 1/1975 Moen ..... A61H 39/08 606/189
3,927,538 A 12/1975 Martella
D241,276 S * 8/1976 Crocker ..... D24/147
3,976,078 A * 8/1976 Toriello ..... A61H 39/08 606/189
D253,000 S * 9/1979 Hanson ..... D21/323
D309,014 S * 7/1990 Akerfeldt ..... D24/146
4,950,279 A * 8/1990 Chang ..... A61H 39/08 606/189
5,104,381 A * 4/1992 Gresl ..... A61B 1/00135 D24/146
6,228,049 B1 * 5/2001 Schroeder ..... A61B 17/3417 604/93.01
D454,591 S * 3/2002 Vidmar ..... D8/391
D526,061 S * 8/2006 Nam ..... D24/146
D545,562 S * 7/2007 Feller ..... D3/28
D547,508 S * 7/2007 Thomas ..... D4/138
D582,481 S * 12/2008 Vaughn ..... D19/65
D598,549 S * 8/2009 Cantu ..... D24/146
D603,502 S * 11/2009 Petersen ..... D24/147
D710,008 S * 7/2014 Yoo ..... D24/146
D782,181 S * 3/2017 Rastogi ..... D3/28
D840,600 S * 2/2019 Nathaniel ..... D28/37
D855,805 S * 8/2019 Chen ..... D24/147
D860,629 S * 9/2019 Schaumann ..... D3/18
D860,633 S * 9/2019 Schaumann ..... D3/28
D909,743 S * 2/2021 Gupta ..... D3/28
D917,871 S * 5/2021 Gupta ..... D3/28
D921,897 S * 6/2021 Chi ..... D24/146
D975,429 S * 1/2023 Wang ..... D3/28
D979,921 S * 3/2023 Gupta ..... D11/207
D980,980 S * 3/2023 Chi ..... D24/147
2003/0225431 A1 * 12/2003 Yoo ..... A61H 39/00 606/189
2005/0027315 A1 * 2/2005 Plateroti ..... A61H 39/00 606/204
2005/0070948 A1 * 3/2005 Kirsteins ..... A61H 39/00 606/189
2014/0025099 A1 * 1/2014 Morrison ..... A61M 37/0076 606/186
2017/0071825 A1 * 3/2017 Li ..... A61H 39/086
2018/0055730 A1 * 3/2018 Ding ..... A61H 39/086
2023/0029886 A1 * 2/2023 Gupta ..... D05B 91/06

OTHER PUBLICATIONS

International Preliminary Report on Patentability; PCT/US2022/011470; Completed Jul. 27, 2023.

* cited by examiner

MAGIC PIN WITH ULTRA GRIP

CLAIM FOR PRIORITY

This application is based on U.S. Provisional Application No. 63/145,696, filed Feb. 4, 2021 of the same title, the priority of which is hereby claimed and the disclosure of which is incorporated herein by reference.

TECHNICAL FIELD

The present invention relates to pins used in connection with sewing; and in particular, to pins with an easy-grasp head to facilitate their use.

BACKGROUND

Pins with improved heads for sewing applications are known in the art. For example, there is disclosed in U.S. Design Pat. No. D860,633 a pin with an elongate tapered ribbed head. When the present inventor was seeking to improve his prior pin design disclosed in U.S. Design Pat. No. D860,633 he found that the seamstresses the present invention is intended to benefit had a number of issues with that prior design which they evaluated as being hard to pick up, hard to grip, manipulate and control, particularly when they were trying to penetrate tougher materials like denim. Accordingly, the inventor provided several tentative designs to be evaluated for possible solutions to the issues they had mentioned. The present design was only one of several submitted to be evaluated. The response was quite surprising, the panels were very impressed by the presently presented design to the exclusion of designs that the present inventor had felt were far more likely to be highly rated when evaluated. In particular, they concluded that they had improved control, particularly with tougher materials and that the present design was easier to pick up, grasp manipulate and control in general; but most emphatically so with tough material like denim.

SUMMARY OF INVENTION

It has been found in accordance with the present invention that a pin with an elongate tapered ribbed head provided with a plurality of projecting rings proximate the pin shaft is vastly easier to manipulate while making garments, especially when using tough fabrics.

There is provided in accordance with the invention a pin comprising:

(a) a pin shaft with a pin point;

(b) an elongate pin head attached to an end of the pin shaft distal to the pin point having a pin head length, wherein the elongate pin head is characterized by an elongate tapered ribbed construction with a plurality of ribs defining a rib profile extending from an outer end of the elongate pin head distal to the pin shaft to an inner end of the elongate pin head proximate the pin shaft, said rib profile having a characteristic outer end dimension which is larger than a characteristic inner end dimension of the rib profile proximate the pin shaft, said elongate pin head being further characterized by a plurality of outwardly projecting gripping rings located a distance from the outer end of the pin head toward the inner end of the pin head.

Still further features, advantages and further aspects will become apparent from the discussion which follows and the accompanying drawings.

BRIEF DESCRIPTION OF DRAWINGS

The invention is described in detail below in connection with the accompanying drawings wherein like numerals designate similar parts and wherein.

DETAILED DESCRIPTION

Figure 1:
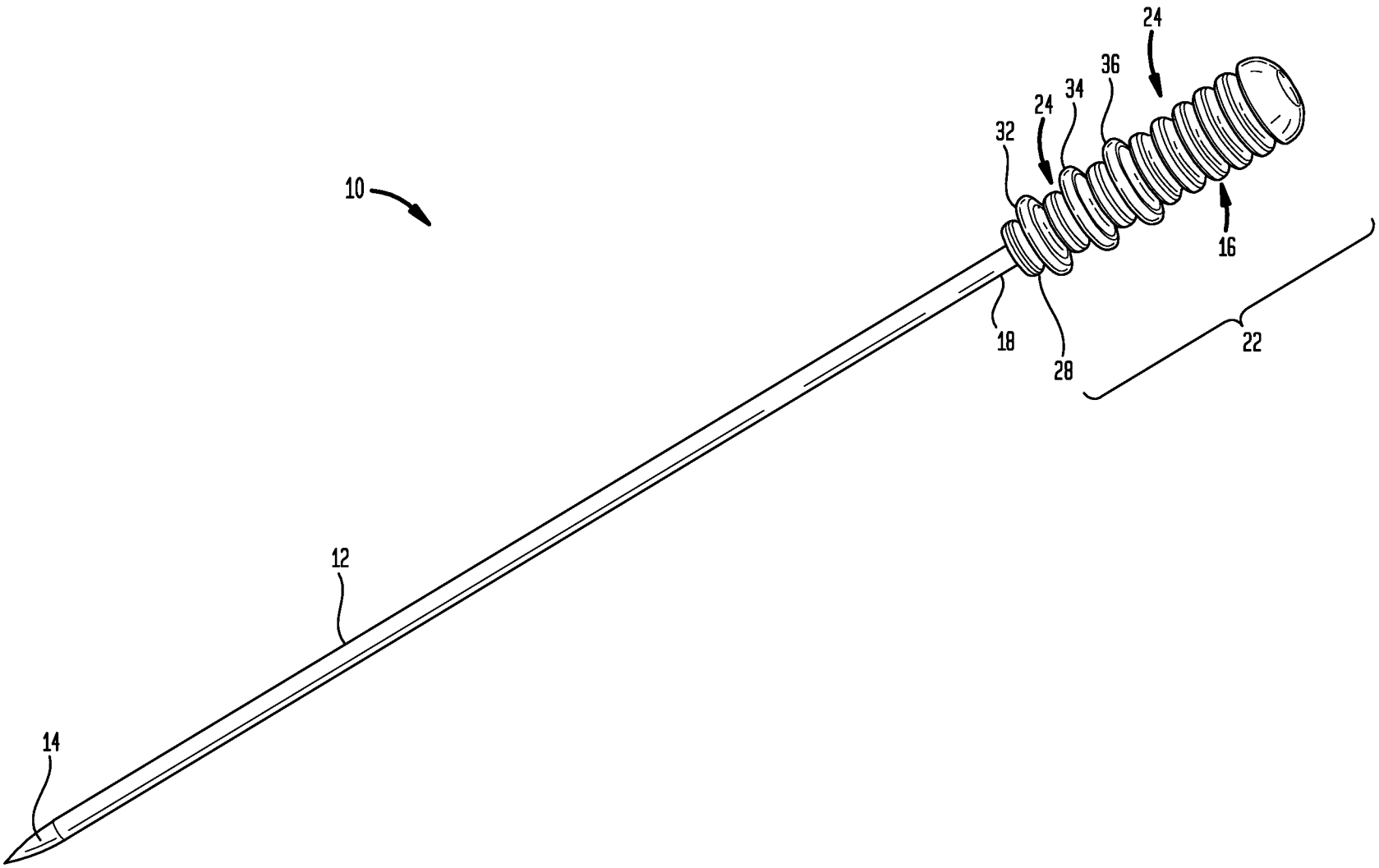
FIG. 1 is a perspective view of a pin of the invention with an elongate tapered ribbed head with projecting rings.
Figure 2:
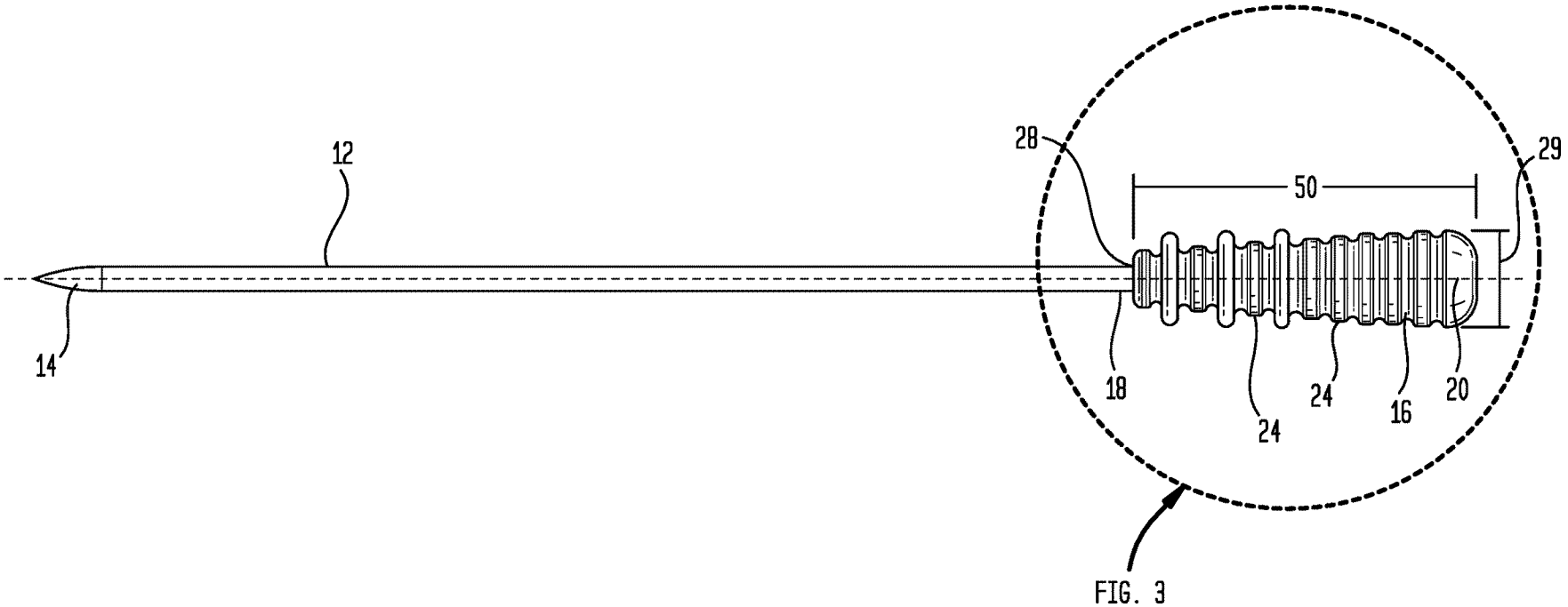
FIG. 2 is a side view of the pin of FIG. 1.
Figure 3:
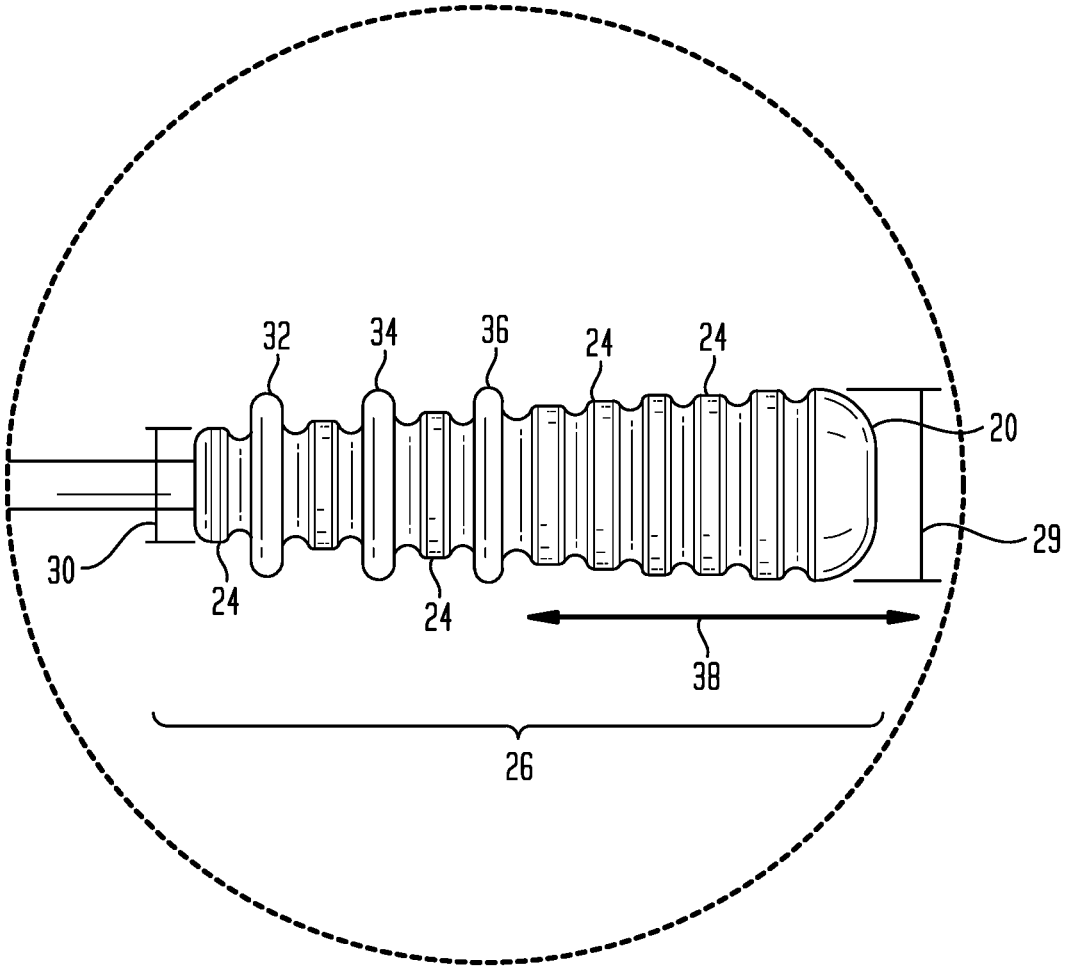
FIG. 3 is an enlarged side view of the elongate tapered ribbed head with projecting rings of FIG. 2.

Referring to the drawings, there is illustrated a pin 10 comprising: (a) a pin shaft 12 with a pin point 14; and (b) an elongate pin head 16 attached to an end 18 of the pin shaft distal to the pin point having a pin head length.

Elongate pin head 16 is characterized by an elongate tapered ribbed construction 22 with a plurality of ribs 24 defining a rib profile 26 extending from an outer end 20 of the elongate pin head distal to the pin shaft 18 to an inner end 28 of the elongate pin head proximate the pin shaft, rib profile 26 having a characteristic outer end dimension 29 which is larger than a characteristic inner end dimension 30 of the rib profile proximate the pin shaft Elongate pin head 16 being further characterized by a plurality of outwardly projecting gripping rings 32, 34, 36 located a distance 38 from outer end 20 of the pin head toward the inner end 28 of the pin head.

In a preferred embodiment, pin head 16 has a generally conical shape as shown, such that the rib profile is generally conical as well. So also, the plurality of outwardly projecting gripping rings are located closer to the pin shaft than to outer end 20 of pin head 16.

Typically, characteristic outer end dimension 29 of the pin head profile is from about 2.5 mm to 4 mm; while in preferred embodiments the plurality of ribs defines an intermediate profile 44 between the outer end of the pin head and a first of the plurality of gripping rings. Along intermediate profile 44, the plurality of ribs have characteristic intermediate profile dimensions 46 of from about 1.5 mm to about 3 mm, with the proviso that the characteristic intermediate profile dimensions are lesser than the characteristic outer end dimension 29 of the pin head profile.

The plurality of outwardly projecting gripping rings usually have a characteristic gripping ring dimension 48 of from 2.5 mm to 4 mm, with the proviso that the characteristic gripping ring dimensions are larger than the characteristic intermediate profile dimensions 46.

Generally, the pin head has an axial length 50 of from about 11 mm to 15 mm, referring to the length along the central axis 52 of the pin; while intermediate profile 44 has an axial length 45 (along central axis 52) of from about 5 mm to 9 mm.

Figure 4:
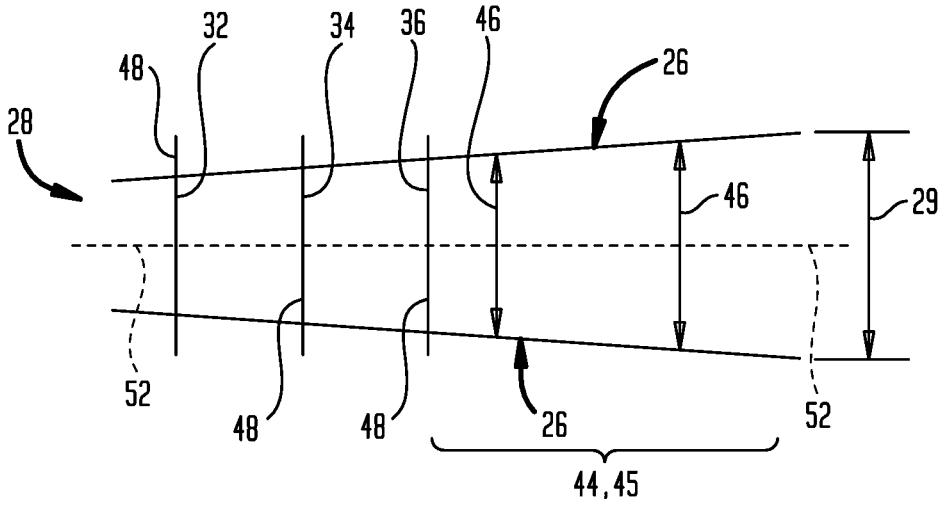
FIG. 4 is a schematic diagram illustrating rib profiles and characteristic dimensions of the pin of FIGS. 1, 2 and 3.

In particularly preferred embodiments, rib profile 26 is characterized by progressively smaller characteristic profile dimensions over the length of the pin head from the outer and to an inner end of the pin head as illustrated schematically in FIG. 4 and pin head 16 has 3 outwardly projecting gripping rings proximate shaft 12.

FIG. 4 indicates schematically the various relative dimensions claimed. Characteristic profile lengths, characteristic gripping ring dimensions and the like refer to the maximum linear dimension of the cross section of the pin head at a given location along its length. For the conical construction illustrated, the characteristic dimension is simply the diameter of the circle of that cross section. For other shapes, the longest linear dimension of the cross section is the characteristic dimension.

The inventive pin may also be described as a pin for use in sewing having an elongate cylindrical body tapering to a point at a first penetrating end and having a bulbous grasping/stopping enlargement located at an opposed second end of said elongate cylindrical body, said elongate cylindrical body having a diameter of at least about 0.25 mm up to about 1.5 mm, said bulbous grasping/stopping enlargement having a pushing portion at a terminus most distal to said point, said pushing portion having a convex cap having a diameter of from about 2 mm to about 5 mm across and a plurality of generally convex grasping rings encircling said elongate cylindrical body formed in said bulbous grasping/stopping enlargement, at least two of said grasping rings being spaced from said convex cap of said pushing portion by a distance of from about 4 to 15 mm, the diameter of said grasping rings being at least 0.35 mm greater than the diameter of adjacent portions of said bulbous grasping/stopping enlargement and being separated from the next adjacent grasping ring by at least about 2.25 mm.

SUMMARY OF EMBODIMENTS

There is provided as Embodiment No. 1 a pin comprising:

(a) a pin shaft with a pin point;

(b) an elongate pin head attached to an end of the pin shaft distal to the pin point having a pin head length, wherein the elongate pin head is characterized by an elongate tapered ribbed construction with a plurality of ribs defining a rib profile extending from an outer end of the elongate pin head distal to the pin shaft to an inner end of the elongate pin head proximate the pin shaft, said rib profile having a characteristic outer end dimension which is larger than a characteristic inner end dimension of the rib profile proximate the pin shaft, said elongate pin head being further characterized by a plurality of outwardly projecting gripping rings located a distance from the outer end of the pin head toward the inner end of the pin head.

Embodiment No. 2 is the pin according to Embodiment No. 1, wherein the pin head has a generally conical shape.

Embodiment No. 3 is the pin according to any of the foregoing Embodiments, wherein the plurality of outwardly projecting gripping rings are located closer to the pin shaft than to the outer end of the pin head.

Embodiment No. 4 is the pin according to any of the foregoing Embodiments, wherein the characteristic outer end dimension of the pin head profile is from about 2.5 mm to 4 mm.

Embodiment No. 5 is the pin according to any of the foregoing Embodiments, wherein the plurality of ribs defines an intermediate profile between the outer end of the pin head and a first of the plurality of gripping rings, wherein the plurality of ribs have characteristic intermediate profile dimensions of from about 1.5 mm to about 3 mm, with the proviso that the characteristic intermediate profile dimensions are lesser than the characteristic outer end dimension of the pin head profile.

Embodiment No. 6 is the pin according to any of the foregoing Embodiments, wherein the plurality of outwardly projecting gripping rings have a characteristic gripping ring dimension of from 2.5 mm to 4 mm, with the proviso that the characteristic gripping ring dimensions are larger than the characteristic intermediate profile dimensions.

Embodiment No. 7 is the pin according to any of the foregoing Embodiments, wherein the pin head has an axial length of from about 11 mm to 15 mm.

Embodiment No. 8 is the pin according to any of the foregoing Embodiments, where the intermediate profile has an axial length of from about 5 mm to 9 mm.

Embodiment No. 9 is the pin according to any of the foregoing Embodiments wherein the rib profile is characterized by progressively smaller characteristic profile dimensions over the length of the pin head from the outer and to an inner end of the pin head.

Embodiment No. 10 is the pin according to any of the foregoing Embodiments, having 3 outwardly projecting gripping rings.

Embodiment No. 11 is a pin for use in sewing having an elongate cylindrical body tapering to a point at a first penetrating end and having a bulbous grasping/stopping enlargement located at an opposed second end of said elongate cylindrical body, said elongate cylindrical body having a diameter of at least about 0.25 mm up to about 1.5 mm, said bulbous grasping/stopping enlargement having a pushing portion at a terminus most distal to said point, said pushing portion having a convex cap having a diameter of from about 2 mm to about 5 mm across and a plurality of generally convex grasping rings encircling said elongate cylindrical body formed in said bulbous grasping/stopping enlargement, at least two of said grasping rings being spaced from said convex cap of said pushing portion by a distance of from about 4 to 15 mm, the diameter of said grasping rings being at least 0.35 mm greater than the diameter of adjacent portions of said bulbous grasping/stopping enlargement and being separated from the next adjacent grasping ring by at least about 2.25 mm.

What is claimed is:

1. A pin comprising:

(a) a pin shaft with a pin point;

(b) an elongate pin head attached to an end of the pin shaft distal to the pin point having a pin head length, wherein the elongate pin head is characterized by an elongate tapered ribbed construction with a plurality of ribs defining a rib profile extending from an outer end of the elongate pin head distal to the pin shaft to an inner end of the elongate pin head proximate the pin shaft, said rib profile having a characteristic outer end dimension which is larger than a characteristic inner end dimension of the rib profile proximate the pin shaft, said elongate pin head being further characterized by a plurality of outwardly projecting gripping rings located a distance from the outer end of the elongate pin head toward the inner end of the elongate pin head;

wherein the plurality of outwardly projecting gripping rings is positioned alternately with a portion of the plurality of ribs;

wherein the pin shaft is a solid cylinder;

wherein the plurality of outwardly projecting gripping rings is axially located closer to the pin shaft than to the outer end of the elongate pin head;

wherein the plurality of ribs defines an intermediate profile between the outer end of the elongate pin head and a first of the plurality of outwardly projecting gripping rings;

wherein the plurality of ribs has characteristic intermediate profile dimensions of from about 1.5 mm to about 3 mm;

wherein the characteristic intermediate profile dimensions are lesser than the characteristic outer end dimension of the rib profile;

wherein the plurality of outwardly projecting gripping rings each have a characteristic gripping ring dimension of from 2.5 mm to 4 mm;

wherein the characteristic gripping ring dimensions are larger than the characteristic intermediate profile dimensions and differ by no more than 1.5 mm from the characteristic outer end dimension.

2. The pin according to claim 1, wherein the elongate pin head has a generally conical shape.

3. The pin according to claim 1, wherein the characteristic outer end dimension of the rib profile is from about 2.5 mm to 4 mm.

4. The pin according to claim 1, wherein the elongate pin head has an axial length of from about 11 mm to 15 mm.

5. The pin according to claim 1, where the intermediate profile has an axial length of from about 5 mm to 9 mm.

6. The pin according to claim 1, wherein the rib profile is characterized by progressively smaller characteristic profile dimensions over the pin head length.

7. The pin according to claim 1, having three outwardly projecting gripping rings.

8. The pin according to claim 1, wherein the plurality of outwardly projecting gripping rings is located within the rib profile and between the plurality of ribs of the elongate pin head.

9. The pin according to claim 1, having three outwardly projecting gripping rings; wherein the elongate pin head has a generally conical shape; and wherein the rib profile is characterized by progressively smaller characteristic profile dimensions over the pin head length.

10. A pin for use in sewing having an elongate cylindrical body tapering to a point at a first penetrating end and having a bulbous grasping/stopping enlargement located at an opposed second end of said elongate cylindrical body, said elongate cylindrical body having a diameter of at least about 0.25 mm up to about 1.5 mm, said bulbous grasping/stopping enlargement having a pushing portion at a terminus most distal to said point, said pushing portion having a convex cap having a diameter of from about 2 mm to about 5 mm across and a plurality of generally convex grasping rings formed in said bulbous grasping/stopping enlargement and encircling said elongate cylindrical body, at least two of said grasping rings being spaced from said convex cap of said pushing portion by a distance of from about 4 mm to 15 mm, the diameter of said grasping rings being at least 0.35 mm greater than the diameter of adjacent portions of said bulbous grasping/stopping enlargement, the diameter of said grasping rings being no more than 2.5 mm different than the diameter of the convex cap, and each of said plurality of grasping rings being separated from the next adjacent grasping ring by at least about 2.25 mm;

wherein the bulbous grasping/stopping enlargement has a plurality of ribs between which the grasping rings are located; and wherein the plurality of generally convex grasping rings has at least one of the plurality of ribs positioned therebetween.

* * * * *